US011633846B2

(12) United States Patent
Blake et al.

(10) Patent No.: US 11,633,846 B2
(45) Date of Patent: Apr. 25, 2023

(54) ERGONOMIC ATTACHMENT FOR A NINETY DEGREE DRILL ASSEMBLY

(71) Applicant: THE BOEING COMPANY, Chicago, IL (US)

(72) Inventors: Ryan L. Blake, Kirkland, WA (US); Ryan D. Jennings, Brier, WA (US)

(73) Assignee: The Boeing Company, Chicago, IL (US)

( * ) Notice: Subject to any disclaimer, the term of this patent is extended or adjusted under 35 U.S.C. 154(b) by 552 days.

(21) Appl. No.: 16/433,456

(22) Filed: Jun. 6, 2019

(65) Prior Publication Data

US 2020/0384630 A1 Dec. 10, 2020

(51) Int. Cl.
*B25G 1/10* (2006.01)
*B25G 3/34* (2006.01)

(52) U.S. Cl.
CPC ..... *B25G 1/102* (2013.01); *B25G 3/34* (2013.01)

(58) Field of Classification Search
CPC ... B25G 3/00; B25G 3/02; B25G 3/34; B25G 1/102; B25B 23/00; B25B 23/08; B25B 23/16
USPC ..... 81/52, 58.2, 180.1, 180.2, 489, 491, 492
See application file for complete search history.

(56) References Cited

U.S. PATENT DOCUMENTS 4,136,579 A * 1/1979 Robinson ..... B25H 1/0057 173/36
6,496,094 B2 * 12/2002 May, III ..... B25B 11/002 211/69
7,191,494 B2 3/2007 Badiali
7,730,589 B2 * 6/2010 Dineen ..... B23B 45/001 16/430
2010/0018355 A1 * 1/2010 Crawford ..... B25B 13/56 81/488
2015/0289633 A1 * 10/2015 Moreau ..... A45F 5/00 29/447

* cited by examiner

*Primary Examiner* — Monica S Carter
*Assistant Examiner* — Alberto Saenz
(74) *Attorney, Agent, or Firm* — Quinn IP Law

(57) ABSTRACT

A removable attachment assembly for a ninety degree drill assembly, which includes a base member and a securement assembly secured to the base member for releasably securing the base member to a housing of the ninety degree drill assembly. The removable attachment assembly further includes a cushion member releasably securable to the base member.

20 Claims, 9 Drawing Sheets

ERGONOMIC ATTACHMENT FOR A NINETY DEGREE DRILL ASSEMBLY

FIELD

This disclosure relates to an attachment for a hand tool and more particularly to an attachment to a ninety degree drill assembly.

BACKGROUND

Ninety degree drill assemblies are used in fabrication of many structures such as for example an aircraft. The operator of the ninety degree drill assembly will utilize the palm of their hand to press against the housing of the drill assembly during the drilling operation. The palm of the operator's hand applies a force against the housing of the drill assembly which in turn transmits the force along the drill bit urging the drill bit in a direction of cutting a hole through a material. The operator in applying this force with the palm of their hand, and particularly in a repetitive manner, can experience some discomfort in the use of the ninety degree drill assembly. Since gloves, for safety purposes, are not always approved for use with a rotary tool or rotary device, the operator's hand needs cushioning from the force experienced by the operator's palm in applying a force to the housing of the ninety degree drill assembly in urging the drill bit in cutting a hole through material.

In addition, with the drill bit of a ninety degree drill assembly extending ninety degrees from the main body of the ninety degree drill assembly, wherein the housing of the main body contains the motor of the drill assembly, the removal of the drill bit from a drilling position often involves the drill bit to be backed off and out of the hole that was drilled and in an opposing direction from a drilling direction. This movement of the drill bit out of operational drilling position can result in the housing of the ninety degree drill assembly colliding with another surface of the structure being fabricated. This can be particularly a concern when drilling with the ninety degree drilling assembly within confined areas. The surface impacted by the drill assembly could result in the surface being marred or damaged resulting in a need to repair that surface.

Additionally, the housing of the ninety degree drill assembly is constructed of a hard material such as metal. Movement of the drilling assembly within the structure being fabricated can result in the housing of the drill assembly colliding with the structure being fabricated by way of moving the drilling assembly within the structure or dropping the drilling assembly within the structure. The collision of the ninety degree drill assembly with the structure being fabricated can also cause marring or damage to a surface of the structure being fabricated. Should the surface include a finished surface, the finished surface will need to be repaired and refinished. As a result, there is a need to protect surfaces of the structure being fabricated from collisions with respect to the housing of the ninety degree drilling assembly so as to reduce the occurrence of marring and/or damage to a surface of the structure being fabricated.

SUMMARY

An example includes a removable attachment assembly for a ninety degree drill assembly, which includes a base member and a securement assembly secured to the base member for releasably securing the base member to a housing of the ninety degree drill assembly. The removable attachment assembly further includes a cushion member releasably securable to the base member.

An example includes a method for installing a removable attachment assembly to a ninety degree drill assembly, which includes a step of securing a base member to a housing of the ninety degree drill assembly with a securement assembly, wherein the securement assembly is secured to the base member and a cushion member is secured to the base member such that the cushion member has a surface which faces in a direction away from the housing.

The features, functions, and advantages that have been discussed can be achieved independently in various embodiments or may be combined in yet other embodiments further details of which can be seen with reference to the following description and drawings.

DESCRIPTION

Figure 1:
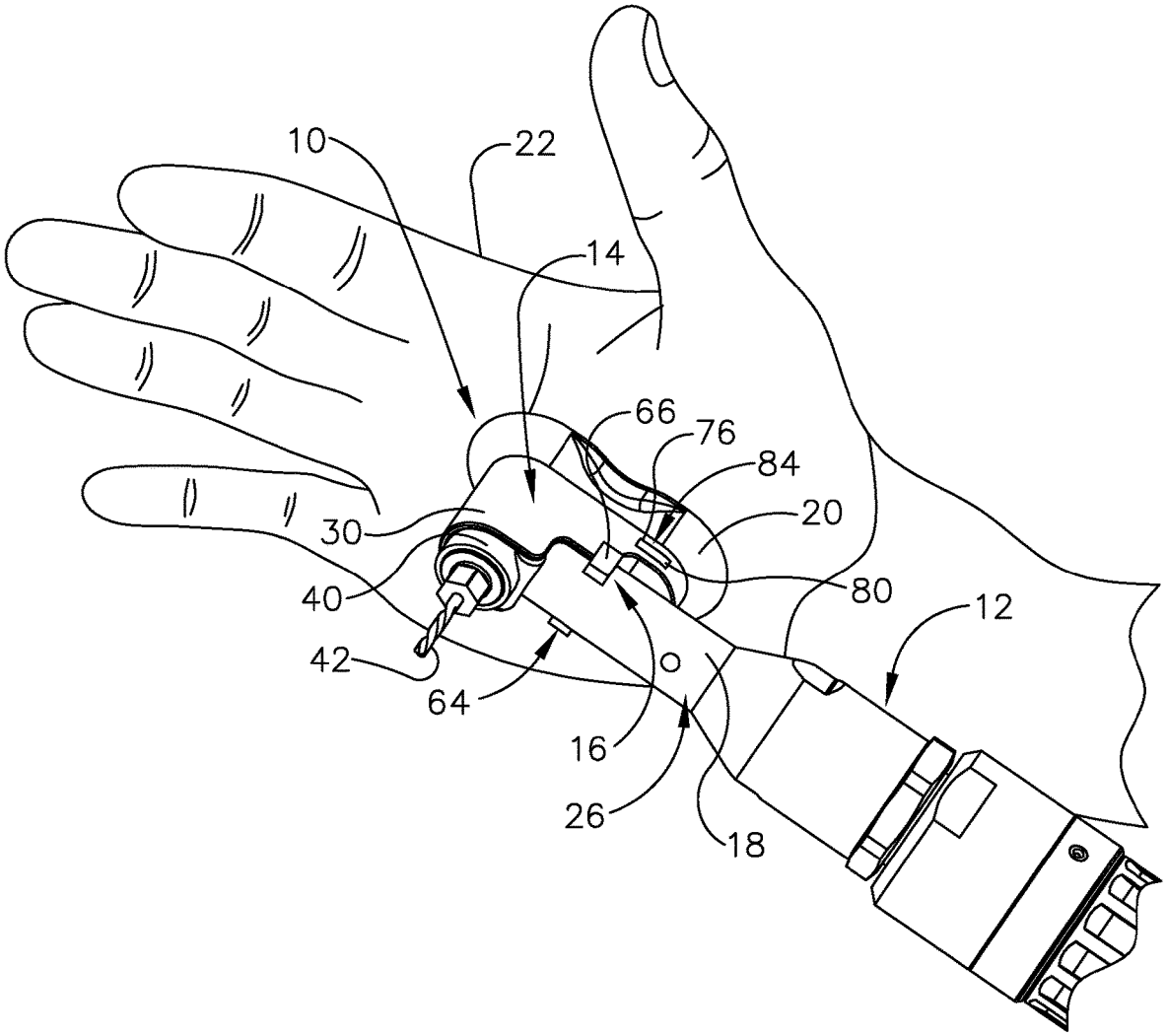
FIG. 1 is a partial perspective view of a ninety degree drill assembly with a removable attachment assembly secured to the ninety degree drill assembly and with a user's hand positioned on the removable attachment assembly for operation of the ninety degree drill assembly.

In referring to FIGS. 1-5 removable attachment assembly 10 for a ninety degree drill assembly 12 includes base member 14 and securement assembly 16 secured to base member 14 for releasably securing base member 14 to housing 18 of ninety degree drill assembly 12. Releasable securement of base member 14 to housing 18 includes attachment and removal of base member 14 with respect to housing 18 without need of a tool. Removable attachment assembly 10 further includes cushion member 20 secured to base member 14.

Base member 14 facilitates alignment and mounting of removable attachment assembly 10 onto ninety degree drill assembly 12 such that cushion member 20, with ninety degree drill assembly 12 in operation, is positioned to contact hand 22 of operator, as seen in FIG. 1. Additionally, securement assembly 16 is secured to base member 14 which secures removable attachment assembly 10 to housing 18 of ninety degree drill assembly 12.

Figure 3:
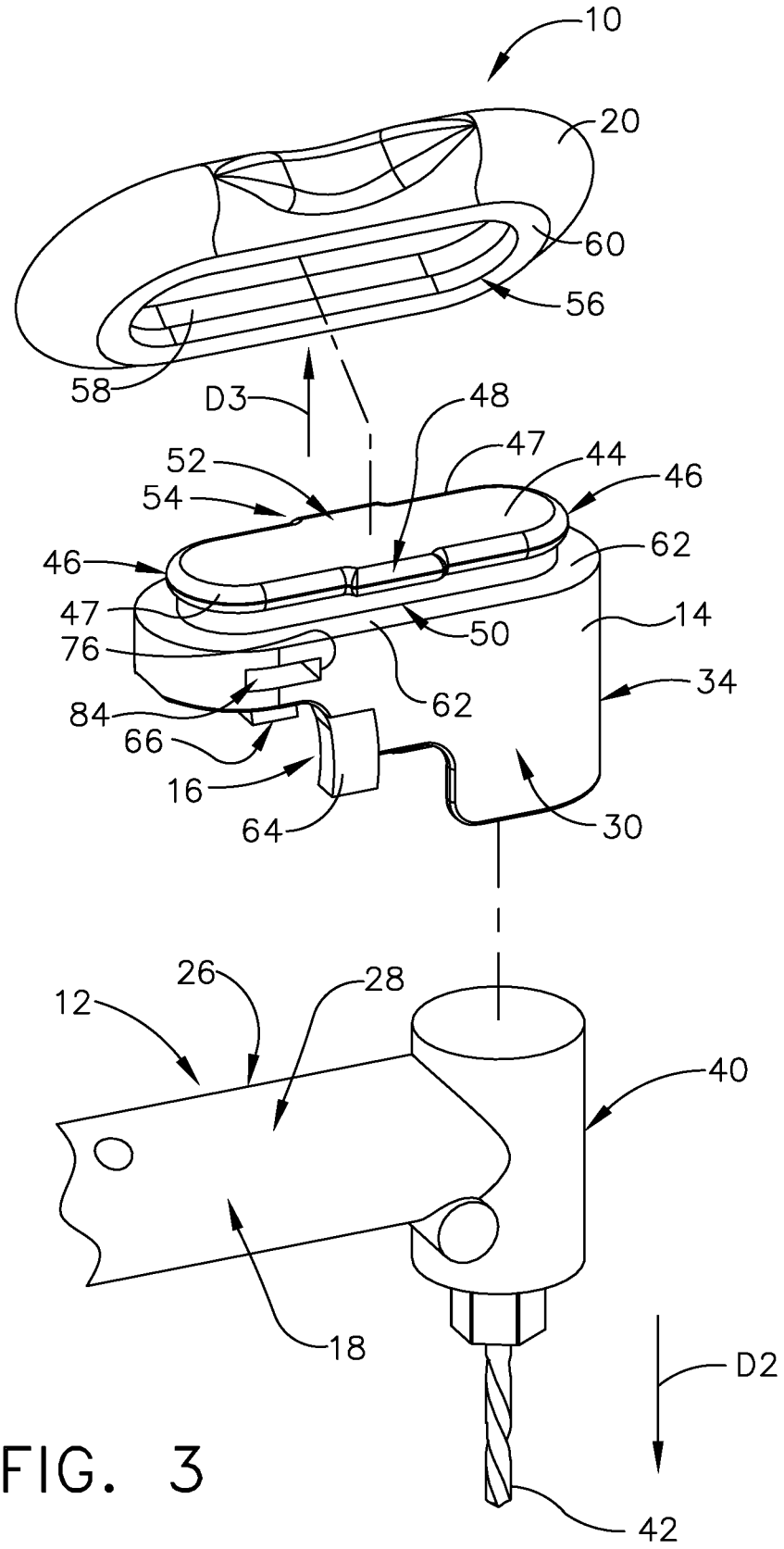
FIG. 3 is an enlarged exploded view of the removable attachment assembly with a cushion member of the removable attachment assembly tilted out of securement alignment with a base member of the removable attachment assembly.
Figure 4:
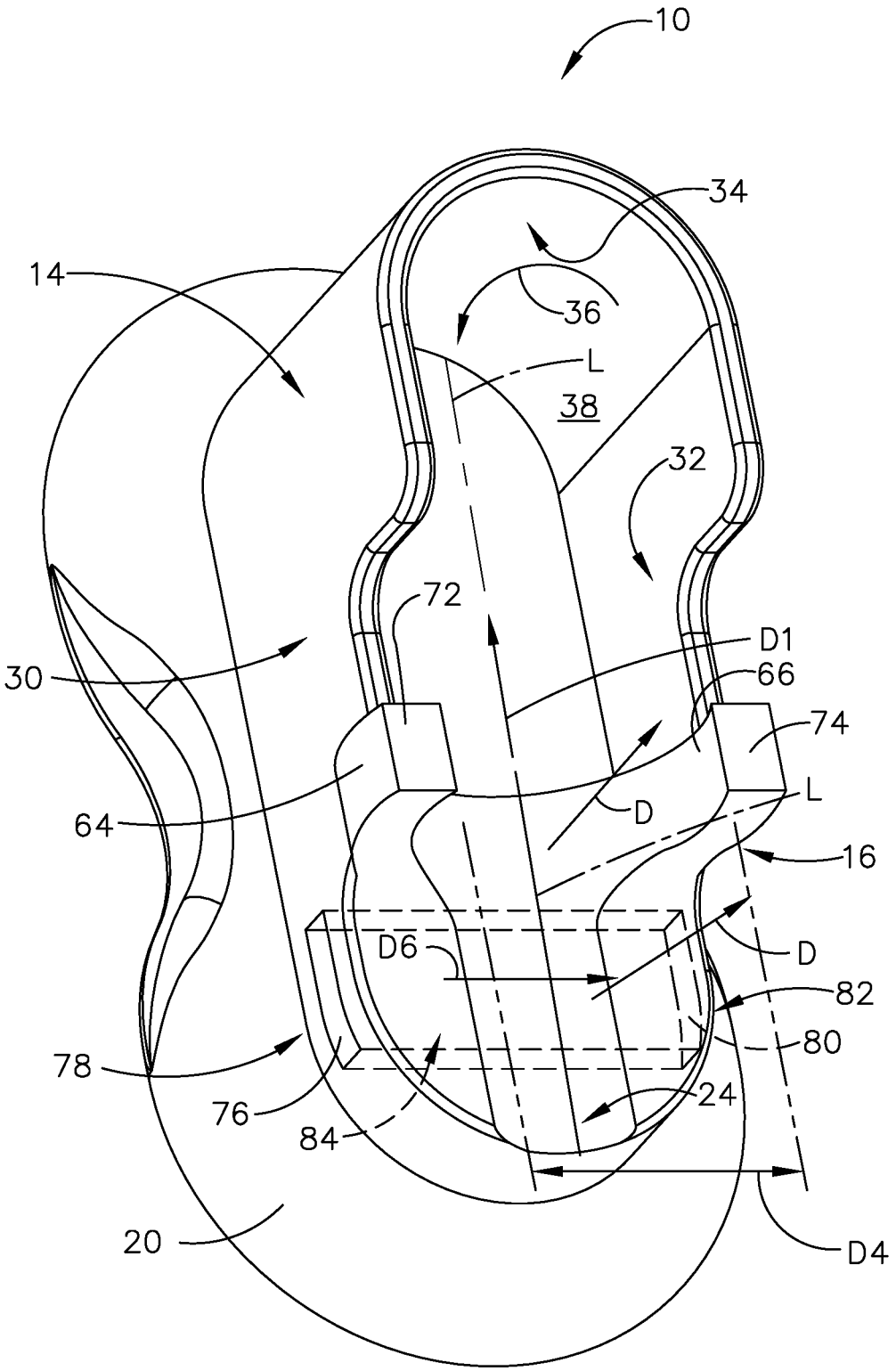
FIG. 4 is a bottom perspective view of the base member of the removable attachment assembly of FIG. 3.

Base member 14 is constructed of a strong material such as one of a thermoplastic, thermoset or metal. In facilitating alignment and mounting base member 14 of removable attachment assembly 10 onto ninety degree drill assembly 12, base member defines concave surface 24, as seen in FIG. 4, which faces in direction D away from cushion member 20 and which extends in direction D1 along length L of base member 14. Concave surface 24 is configured in this example to complement the shape of housing 18 to which base member 14 contacts. In this example, housing 18, which includes portion of drive shaft housing 26, has a curved surface 28, as seen in FIG. 3, to which concave surface 24 has a complementary configuration for mounting of removable attachment assembly 10 so as to have a stable interface between housing 18 and base member 14. With portion of drive shaft housing 26, in this example, positioned within concave surface 24, base member 14 is positioned in alignment with portion of drive shaft housing 26.

In referring to FIG. 4, base member 14 further defines first wall portion 30 and second wall portion 32 which are spaced apart from one another. First wall portion 30 and second wall portion 32 each extend in the direction D away from cushion member 20 and first wall portion 30 and second wall portion 32 each extend in the direction D1 along length L of base member 14. Base member 14 further includes defining third wall portion 34 which connects together first wall portion 30 and second wall portion 32. In this example, third wall portion 34 extends in curvilinear direction 36. In this example, as shown in FIG. 4, first, second and third wall portions 30, 32 and 34 configure a receptacle 38 for receiving, aligning and mounting base member 14 to housing 18 of ninety degree drill assembly 12, and more particularly in this example, mounting to portion of drive shaft housing 26 and to ninety degree offset housing portion 40 of housing 18.

Figure 2:
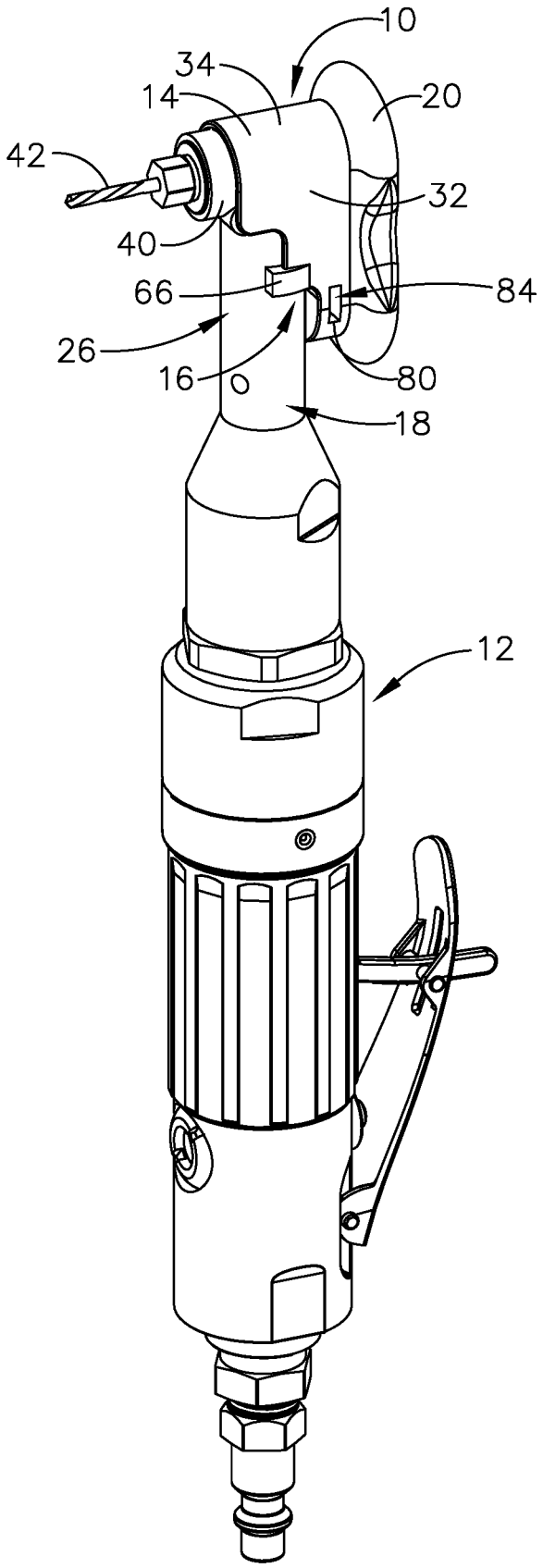
FIG. 2 is a side perspective elevation view of the ninety degree drill assembly of FIG. 1 with the removable attachment assembly secured to the ninety degree drill assembly.
Figure 6:
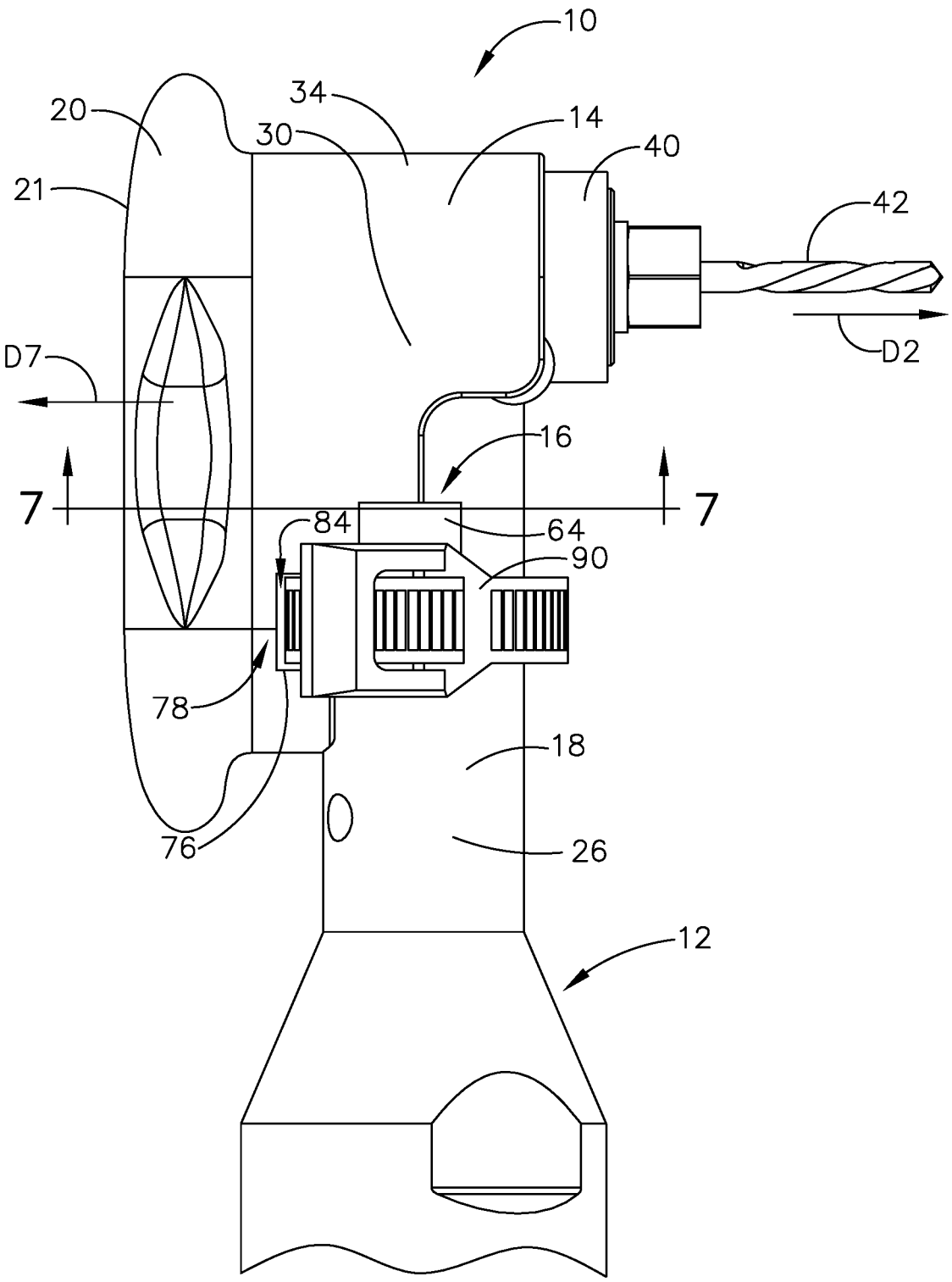
FIG. 6 is a partial an enlarged side elevation view of the removable attachment assembly secured to the ninety degree drill assembly with a zip tie additionally securing the removable attachment assembly to the ninety degree drill assembly.
Figure 8:
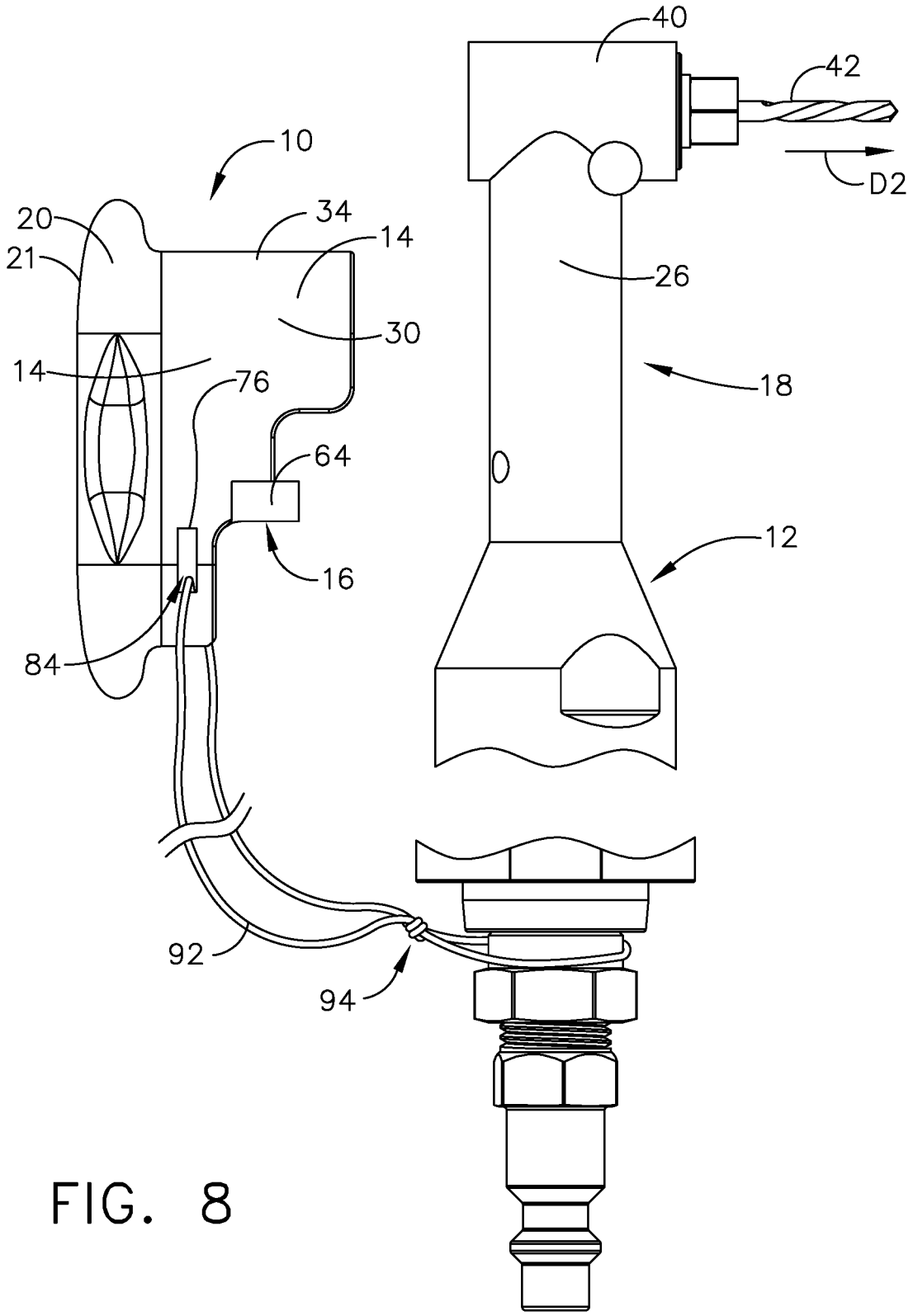
FIG. 8 is an enlarged side elevation view of the ninety degree drill assembly with the removable attachment assembly removed from securement to the ninety degree drill assembly and tethered to the ninety degree drill assembly.

First wall portion 30 and second wall portion 32, which are spaced apart from one another, receive a portion of drive shaft housing 26, as seen in FIGS. 1-3. Third wall portion 34 encloses a portion of ninety degree off set housing portion 40 with base member 14 mounted onto housing 18 of ninety degree drill assembly 12. With base member 14 mounted to housing 18 of ninety degree drill assembly 12, cushion member 20 is positioned between hand 22 of the operator and housing 18, as seen in FIG. 1, for drilling operations. In drilling operations, hand 22 of the operator, in this example, pushes against cushion member 20 and base member 14 in turn pushes against housing 18 urging drill bit 42 in direction D2, as seen in FIGS. 3, 6 and 8, in cutting through material (not shown) in forming a hole (not shown) in the material (not shown).

Figure 7:
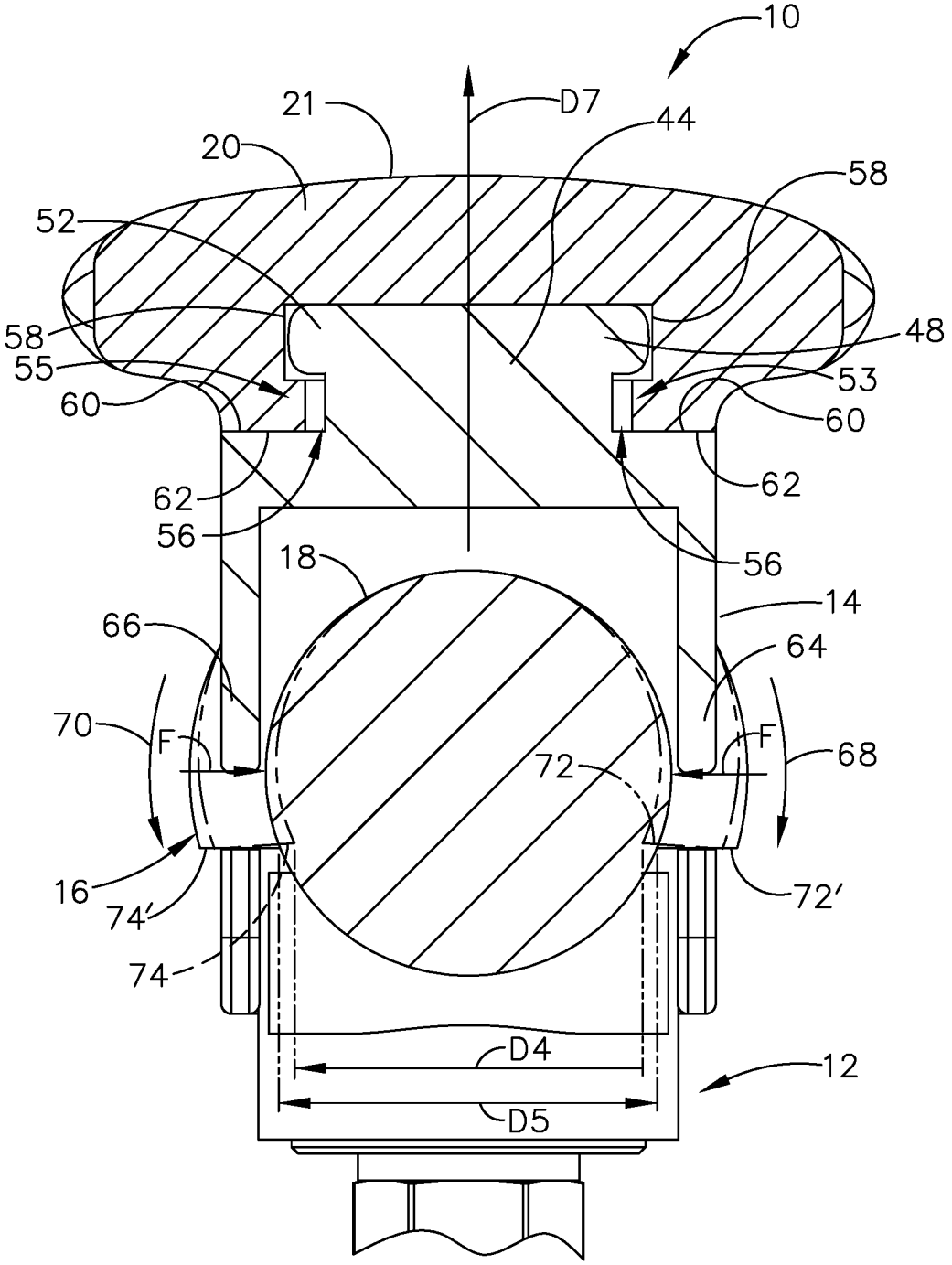
FIG. 7 is an enlarged cross section view along line 7-7 of FIG. 6, with the removable attachment assembly secured to the ninety degree drill assembly with a first and second arms of a securement assembly securing to housing of the ninety degree drill assembly and showing in phantom the position of the first and second arms of the securement assembly without being secured to the housing of the ninety degree drill assembly.

In referring to FIG. 3, base member 14 includes projection 44, which extends in direction D3 away from securement assembly 16. Projection 44, in this example, defines rim 46, which extends along perimeter 47 of the projection 44. First tab 48 of projection 44 extends away from rim 46 on a first side 50 of projection 44 and second tab 52 of projection 44 extends away from rim 46 on second opposing side 54 of projection 44. Cushion member 20 defines first recess 56 within cushion member 20 for receiving projection 44 within cushion member 20 and defines second recess 58 within first recess 56 as seen in FIGS. 3 and 7 for receiving first tab 48 and second tab 52 with positioning projection 44 within the first recess 56. With first tab 48 positioned within second recess 58 and second tab 52 positioned within second recess 58, an interference fit is created between first tab and second recess 58 and second tab 52 and second recess 58. Second recess 58 is positioned spaced apart from bottom surface 60 of cushion member 20, wherein with first and second tabs 48, 52 positioned within second recess 58 bottom surface 60 abuts support surface 62 defined by base member 14.

Cushion member 20 is constructed of resilient material such as for example thermoplastic polyurethane material. This resilient material will maintain the interference fit of first tab 48 with second recess 58 and of second tab 52 with second recess 58. This material will provide cushion member 20 firm securement to base member 14 and allow, as needed, the operator to remove cushion member 20 from projection 44 of base member 14 without incurring damage to either cushion member 20 or base member 14. In securing cushion member 20 to projection 44, operator positions projection 44 within first recess 56 and pushes cushion member 20 and projection 44 together such that at least one of first tab 48 and second tab 52 flexes the resilient material of cushion member 20 at first portion 53 and/or second portion 55 of cushion member 20, as seen in FIG. 7, wherein first portion 53 and second portion 55 are each adjacent to second recess 58. Flexing of the resilient material in at least one of first and second portions 53, 55 permits at least one of first and second tabs 48, 52 to be positioned within second recess 58, as seen in FIG. 7 creating an interference fit. In removing cushion member 20 from projection 44, operator pulls on cushion member 20 such that at least one of first tab 48 and second tab 52 flex the resilient material of at least one of first and second portions 53, 55 of cushion member 20 adjacent second recess 58 permitting first and second tabs 48, 52 to be removed from second recess 58 overcoming the interference fit and thereafter removed from first recess 56.

Figure 5:
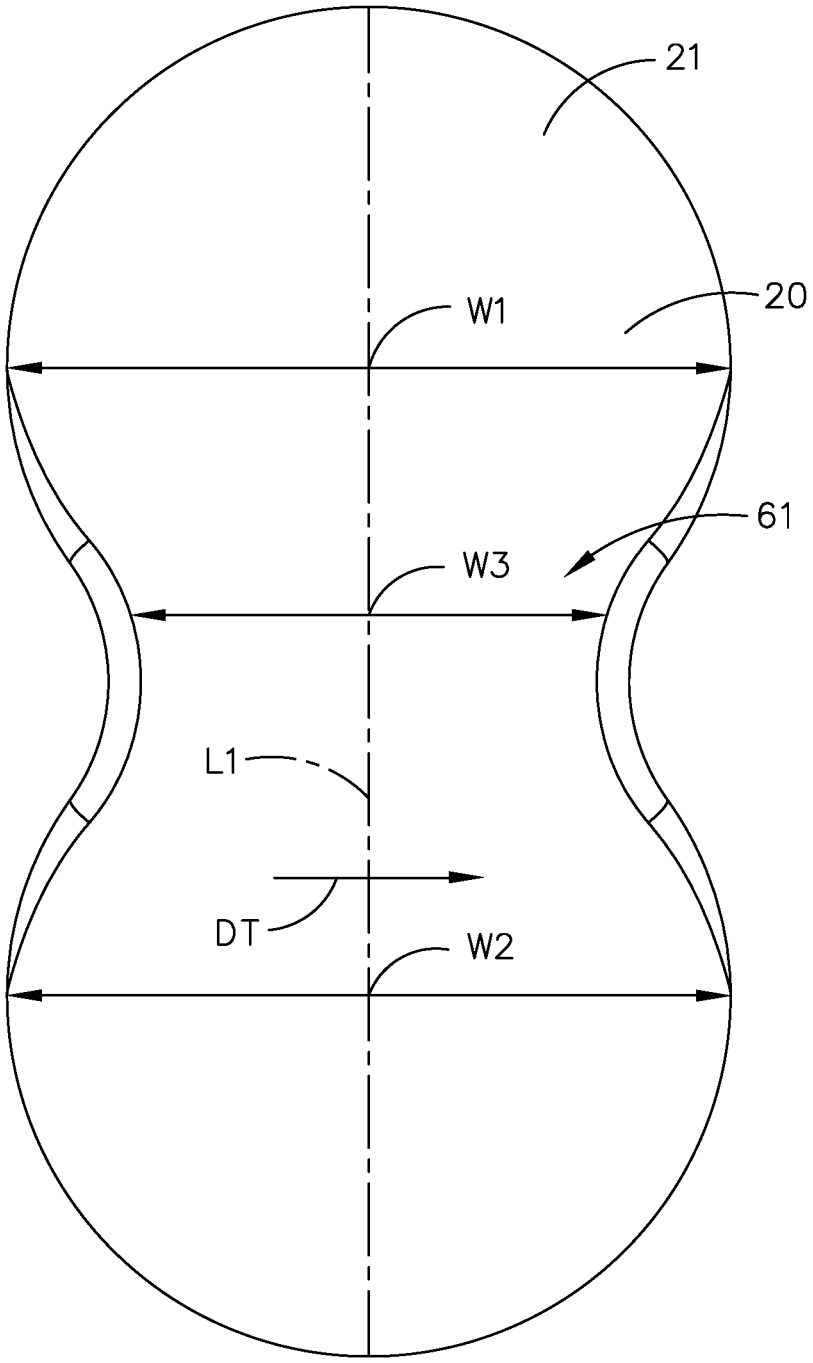
FIG. 5 is a top plan view of the cushion member of the removable attachment assembly of FIG. 3.

In referring to FIG. 5, cushion member 20 includes first width dimension Wland second width dimension W2 which each extends in transverse direction DT relative to length L1 of cushion member 20 and are spaced apart along length L1 of cushion member 20 from one another. Third width dimension W3 of cushion member 20 extends in transverse direction DT relative to length L1 of cushion member 20 and is positioned spaced apart from and in between the first width dimension W1 of cushion member 20 and second width dimension W2 of cushion member 20 wherein third width dimension W3 is less than each of first and second width dimensions W1, W2. This varying width configuration of cushion member 20 provides for a lesser width dimension in a central portion 61 of cushion member 20 as seen in FIG. 5. This reduction of width dimension in central portion 61 of cushion member 20 provides operator ease in straddling, for example, a thumb and an index finger of an operator on either side of cushion member 20 in order to hold a drill guide (not shown) which may be used for a drilling operation with ninety degree drill assembly 12. The narrowed central portion 61 of cushion member 20 permits the operator to comfortably hold a drill guide with for example a thumb and index finger straddling cushion member 20 at central portion 61 and at the same time use a remainder portion of the same hand of the operator to apply a pushing force against cushion member 20 during the drilling operation.

Securement assembly 16, as seen in FIGS. 4 and 7, in this example, includes first arm member 64 and second arm member 66, which extend in direction D away from cushion member 20. First arm member 64 has a first curvilinear configuration 68 and the second arm member 66 has a second curvilinear configuration 70. First arm member 64 and second arm member 66, in this example, are each constructed of one of a thermoplastic, thermoset or metal material, which provides resilience to first and second arm members 64, 66 such that first and second arm members 64, 66 can move in and out of an interference fit with housing 18, as described below.

With first and second arm members 64, 66 not engaged to housing 18 of ninety degree drill assembly 12, as shown in FIG. 4 and as shown in phantom in FIG. 7, first free end 72 of first arm member 64 and second free end 74 of second arm member 66 are positioned spaced apart first distance D4, as seen in FIG. 7. With insertion of the housing 18 between first arm member 64 and second arm member 66, first free end (designated as) 72' and second free end (designated as) 74' are then spaced apart a second distance D5, which is a greater distance than first distance D4, which results in first and second arm members 64, 66 exerting a compressive force F onto housing 18 providing an interference fit between housing 18 and first and second arm members 64, 66.

In referring to FIG. 4, base member 14 defines first opening 76 positioned on first side 78 of base member 14 and second opening 80 positioned on opposing second side 82 of base member 14. Base member 14 defines slot 84 which extends through base member 14 from first opening 76 to second opening 80 such that slot 84 is accessible from first opening 76 and from second opening 80. Slot 84 extends, in this example, in direction D6 transverse to length L of base member 14 as seen in FIG. 4. Slot 84, as will be discussed herein, is utilized in conjunction with zip tie member 90, as seen in FIG. 6, for additional securement of base member 14 to housing 18. Additionally, slot 84 can facilitate securement of lanyard member 92, as seen in FIG. 8, for preventing removal attachment assembly 10 from being separated from ninety degree drill assembly 12 and become unwanted debris within the structure being fabricated such as an aircraft.

Figure 9:
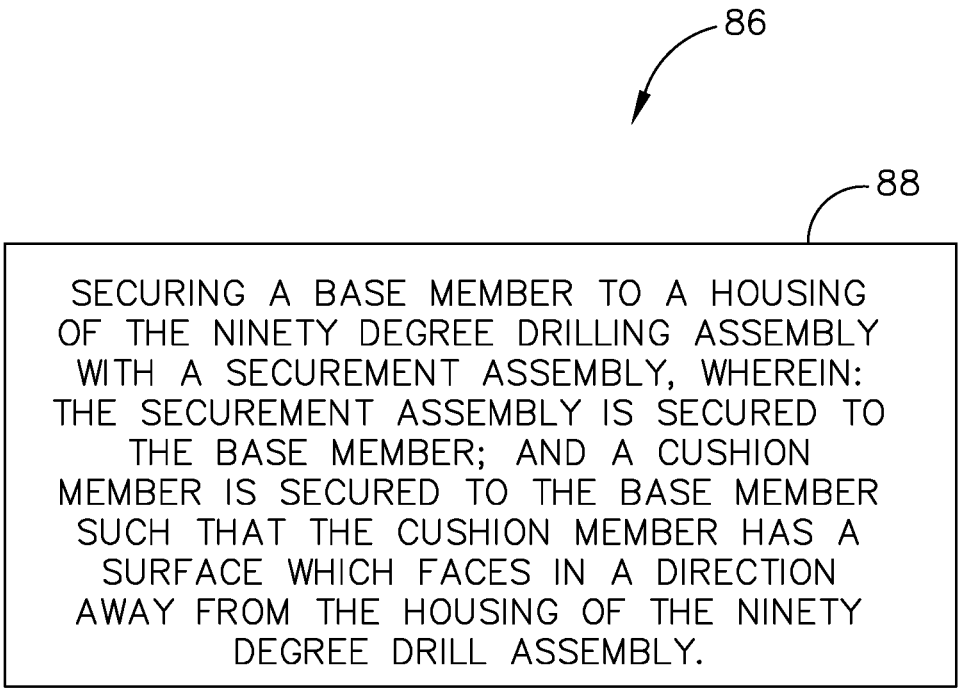
FIG. 9 is a flow chart of a method for installing a removable attachment assembly to a ninety degree drill assembly.

In referring to FIG. 9, method 86 for installing removable attachment assembly 10 to a ninety degree drill assembly 12 includes step 88 of securing base member 14 to housing 18 of the ninety degree drill assembly 12 with securement assembly 16. Securement assembly 16 is secured to base member 14. Cushion member 20 is secured to base member 14 such that cushion member 20 has surface 21 which faces direction D7 away from housing 18, as seen in FIG. 7. With surface 21 of cushion member 20 positioned facing in direction D7 away from housing 18, cushion member 20 provides operator's hand cushioning, with operator's hand 22 pushing against surface 21 of cushion member 20 and operator urging drill bit 42 through material of hole being drilled during operation of ninety degree drill assembly 12.

Cushion member 20 can be easily replaced by the operator with base member 14 having projection 44 which extends in direction D3 away from securement assembly 16, as seen in FIG. 3. Projection 44, in this example as described above, defines rim 46, which extends along perimeter 47 of the projection 44. First tab 48 of projection 44 extends away from rim 46 on a first side 50 of projection 44 and second tab 52 of projection 44 extends away from rim 46 on second opposing side 54 of projection 44. Cushion member 20 defines first recess 56 within the cushion member for receiving projection 44 and defines second recess 58 for receiving first tab 48 and second tab 52, as seen in FIG. 7, with positioning projection 44 within the first recess 56. With first tab 48 positioned within second recess 58 and second tab 52 positioned within second recess 58, an interference fit is created between first tab and second recess 58 and second tab 52 and second recess 58. Second recess 58 is positioned spaced apart from bottom surface 60 of cushion member 20, wherein with first and second tabs 48, 52 positioned within second recess 58 bottom surface 60 abuts support surface 62 defined by base member 14.

Cushion member 20 is constructed of resilient material such as for example thermoplastic polyurethane material. This resilient material will maintain the interference fit of first tab 48 with second recess 58 and of second tab 52 with second recess 58. This material will provide cushion member 20 firm securement to base member 14 and will allow, as needed, the operator to remove cushion member 20 from projection 44 of base member 14 without incurring damage to either cushion member 20 or base member 14. As mentioned earlier, in securing cushion member 20 to projection 44, operator positions projection 44 within first recess 56 and pushes cushion member 20 and projection member 44 together such that at least one of first tab 48 and second tab 52 flexes the resilient material of cushion member 20 at first portion 53 and/or second portion 55 of cushion member 20, as seen in FIG. 7, wherein first portion 53 and second portion 55 are each adjacent to second recess 58. Flexing of the resilient material in at least one of first and second portions 53, 55 permits at least one of first and second tabs 48, 52 to be positioned within second recess 58, as seen in FIG. 7, creating an interference fit. In removing cushion member 20 from projection 44, operator pulls on cushion member 20 such that at least one of first tab 48 and second tab 52 flex the at least one of first portion and second portion 53, 55 of the resilient material of cushion member 20 adjacent second recess 58 permitting first and second tabs 48, 52 to be removed from second recess 58 overcoming the interference fit and thereafter removed from first recess 56.

Method 86 for installing removable attachment assembly 10 to ninety degree drill assembly 12, as seen in FIG. 6, further includes positioning zip tie member 90 to extend through first opening 76 defined on first side 78 of base member 14 and through second opening 80 defined on second side 82, as seen in FIG. 4, of base member 14. Further securing removable attachment assembly 10 to ninety degree drill assembly 12 further includes positioning zip tie member 90 about housing 18 of ninety degree drill assembly 12, as seen in FIG. 6, and cinching zip tie member 90 securely together against housing 18.

In the interest of operator not losing or misplacing removable attachment assembly 10 and removable attachment assembly 10 possibly becoming unwanted debris within the structure being fabricated, method 86 for installing removable attachment assembly 10 to a ninety degree drill assembly 12 further includes positioning lanyard member 92, as seen in FIG. 8, through first opening 76 defined on first side 78 of base member 14 and through second opening 80 defined on second side 82, as seen in FIG. 4, of base member 14. Positioning lanyard member 92 further includes securing lanyard member 92 to ninety degree drill assembly 12 with positioning lanyard member 92 about housing 18 of ninety degree drill assembly 12 and tying, in this example, securement knot 94. Lanyard member 92 will keep removable attachment assembly 10 tied to ninety degree drill assembly 12 and prevent removable attachment assembly 10 from becoming unwanted debris within the structure being fabricated.

While various embodiments have been described above, this disclosure is not intended to be limited thereto. Variations can be made to the disclosed embodiments that are still within the scope of the appended claims.

What is claimed:

1. A removable attachment assembly for a ninety degree drill assembly including a housing, the removable attachment assembly comprising:

a base member;

a securement assembly secured to the base member for releasably securing the base member to the housing;

a cushion member releasably securable to the base member, such that, with the cushion member secured to the base member and the base member secured to the housing, at least a portion of the base member and at least a portion of the cushion member are in an overlying relationship with a ninety degree offset portion of the housing and at least the portion of the base member and at least the portion of the cushion member are aligned with the ninety degree offset portion;

the base member includes a projection which extends in a direction away from the securement assembly, wherein:

the projection defines a rim which extends along a perimeter of the projection; and the projection includes a first tab that extends away from the rim on a first side of the projection and a second tab that extends away from the rim on a second opposing side of the projection; and the cushion member defines a first recess within the cushion member for receiving the projection within the cushion member and defines a second recess within the first recess for receiving the first tab within the second recess and for receiving the second tab within the second recess with positioning the projection within the first recess, wherein with the first tab positioned within the second recess and the second tab positioned within the second recess, an interference fit is created with a first portion of the cushion member positioned between the first tab and a bottom surface of the cushion member and with a second portion of the cushion member positioned between the second tab and the bottom surface of the cushion member.

2. The removable attachment assembly of claim 1, wherein the base member defines a concave surface which faces in a direction away from the cushion member and which extends in a direction along a length of the base member.

3. The removable attachment assembly of claim 1, wherein the base member defines a first opening positioned on a first side of the base member and a second opening positioned on an opposing second side of the base member.

4. The removable attachment assembly of claim 3, wherein the base member defines a slot which extends through the base member from the first opening to the second opening such that the slot is accessible from the first opening and from the second opening.

5. The removable attachment assembly of claim 1, wherein the base member further defines a first wall portion and a second wall portion which are spaced apart from one another, wherein:

the first wall portion and the second wall portion each extend in a direction away from the cushion member; and the first wall portion and the second wall portion each extend in a direction along a length of the base member.

6. The removable attachment assembly of claim 5, further including a third wall portion which connects together the first and second wall portions.

7. The removable attachment assembly of claim 6, wherein the third wall portion extends in a curvilinear direction.

8. The removable attachment assembly of claim 1, wherein the securement assembly comprises a first arm member and a second arm member which extend in a direction away from the cushion member.

9. The removable attachment assembly of claim 8, wherein the first arm member has a first curvilinear configuration and the second arm member has a second curvilinear configuration.

10. The removable attachment assembly of claim 9, wherein the first arm member and the second arm member are each constructed of one of a thermoplastic, thermoset or metal material.

11. The removable attachment assembly of claim 10, wherein a first free end of the first arm member and a second free end of the second arm member are positioned spaced apart a first distance.

12. The removable attachment assembly of claim 11, wherein the first free end and the second free end are spaced apart a second distance when the housing is inserted between the first arm member and the second arm member, wherein the second distance is a greater distance than the first distance, and the first and second arm members exert a compressive force onto the housing for providing an interference fit between the housing and the first and second arm members.

13. The removable attachment assembly of claim 1, wherein the second recess is positioned spaced apart from the bottom surface of the cushion member, wherein with the first and second tabs positioned within the second recess, the bottom surface of the cushion member abuts a support surface defined by the base member.

14. The removable attachment assembly of claim 1, wherein the cushion member comprises:

a first width dimension of the cushion member and a second width dimension of the cushion member which each extend in a transverse direction relative to a length of the cushion member and are spaced apart along the length of the cushion member from one another; and a third width dimension of the cushion member extends in the transverse direction relative to the length of the cushion member and is positioned spaced apart from and in between the first width dimension of the cushion member and the second width dimension of the cushion member, wherein the third width dimension is less than each of the first and second width dimensions.

15. The removable attachment assembly of claim 1, wherein the cushion member is constructed of a thermoplastic polyurethane material.

16. The removable attachment assembly of claim 1, wherein:

the base member defines a receptacle that is open in a first direction that faces away from the cushion member;

the securement assembly includes a first arm member and a second arm member each extending outwardly from the base member and spaced apart from each other to define an opening therebetween; and the opening between the first arm member and the second arm member faces in a same direction as the receptacle of the base member such that the opening is open in the first direction.

17. A method for installing a removable attachment assembly to a ninety degree drilling assembly, the method comprising:

securing a base member to a housing of the ninety degree drilling assembly with a securement assembly, wherein:

the securement assembly is secured to the base member; and a cushion member is secured to the base member such that the cushion member has a surface which faces in a direction away from the housing of the ninety degree drilling assembly, such that, with the cushion member secured to the base member and the base member secured to the housing, at least a portion of the base member and at least a portion of the cushion member are in an overlying relationship with a ninety degree offset housing portion of the ninety degree drill assembly and at least the portion of the base member and at least the portion of the cushion member are aligned with the ninety degree offset housing portion.

18. The method for installing of claim 17, wherein:

the base member includes a projection which extends in a direction away from the securement assembly;

the projection defines a rim extending along a perimeter of the projection and a first tab extending away from the rim on a first side of the projection and a second tab extending away from the rim on a second opposing side of the projection; and the cushion member defines a first recess within the cushion member for receiving the projection and defines a second recess for receiving the first tab within the second recess and the second tab within the second recess with positioning the projection within the first recess, wherein with the first tab positioned within the second recess and the second tab positioned within the second recess an interference fit is created with a first portion of the cushion member positioned between the first tab and a bottom surface of the cushion member and with a second portion of the cushion member positioned between the second tab and the bottom surface of the cushion member.

19. The method for installing of claim 17, further including:

positioning a zip tie member to extend through a first opening defined on a first side of the base member and through a second opening defined on a second side of the base member; and positioning the zip tie member about the housing of the ninety degree drill assembly.

20. The method for installing of claim 17, further including:

positioning a lanyard member through a first opening defined on a first side of the base member and through a second opening defined on a second side of the base member; and securing the lanyard member to the ninety degree drill assembly.

* * * * *